US005947212A

United States Patent [19]

Huang

[11] Patent Number: 5,947,212

[45] Date of Patent: Sep. 7, 1999

[54] DUAL-MODE FASTENER-DRIVING TOOL

[76] Inventor: Chin-Chung Huang, No. 30-10, Chiu-She Lane, Pei-Dist., Taichung, Taiwan

[21] Appl. No.: 09/099,679

[22] Filed: Jun. 18, 1998

[51] Int. Cl.[6] ..... B25B 17/00

[52] U.S. Cl. ..... 173/216; 173/48; 81/57.3; 81/490

[58] Field of Search ..... 173/48, 216, 217, 173/170; 81/57.3, 57.42, 490, 177.4, 59.1

[56] References Cited

U.S. PATENT DOCUMENTS

| | | | |
|---|---|---|---|
| 4,846,027 | 7/1989 | Lu | 81/57.31 |
| 5,406,866 | 4/1995 | Badiali | 81/57.3 |
| 5,427,003 | 6/1995 | Boltak et al. | 81/490 |
| 5,651,294 | 7/1997 | Shiao | 81/59.1 |
| 5,699,702 | 12/1997 | Myers | 81/57.3 |
| 5,782,146 | 7/1998 | Lin | 81/177.4 |

*Primary Examiner*—Scott A. Smith
*Attorney, Agent, or Firm*—Jenkens & Gilchrist, P.C.

[57] ABSTRACT

A dual-mode fastener-driving tool is operable in a first mode, where a drive shaft is driven to rotate relative to a handle body by a drive ring and a driven gear assembly, and a second mode, where the handle body is forced downward to enable a clutch unit to engage the drive shaft and permit rotation of the drive shaft with the handle body.

17 Claims, 8 Drawing Sheets

DUAL-MODE FASTENER-DRIVING TOOL

BACKGROUND OF THE INVENTION

1. Field of the Invention

The invention relates to a fastener-driving tool, more particularly to a fastener-driving tool that is operable in a low-torque high-speed mode and in a high-torque low-speed mode.

2. Description of the Related Art

Referring to FIGS. 1 and 2, a conventional dual-mode fastener-driving tool is shown to include a tubular handle body 1 and a switch unit 2 that is mounted on a top end of the handle body 1 and that extends into the same. A clutch unit 3 is installed in an intermediate portion of the handle body 1, while a mounting plate 4 is retained on a bottom end of the handle body 1. Two driven gear sets 6 are disposed below the mounting plate 4 and are mounted rotatably on the same by means of bolts 5. Each driven gear set 6 includes a primary driven gear 6*a* and a secondary driven gear 6*b* that meshes with the primary driven gear 6*a*. A drive ring 7 encloses the driven gear sets 6 and is formed with gear teeth 7*a* on an inner wall surface thereof for meshing with the primary driven gear 6*a*. The drive ring 7 is mounted rotatably on a drive shaft 8 having an upper portion that extends coaxially into the handle body 1 from the bottom end of the latter, and a lower portion that extends through the mounting plate 4 and the drive ring 7 and that is disposed between the secondary driven gears 6*b* of the driven gear sets 6. The lower portion of the drive shaft 8 is formed with gear teeth 8*a* for meshing with the secondary driven gears 6*b*. The upper portion of the drive shaft 8 is provided with a locking component 8*b* for engaging a drive component 3*a* of the clutch unit 3. The lower portion of the drive shaft 8 is further provided with an adapter 8*c* for coupling with a tool bit 9.

When it is desired to operate the fastener-driving tool in a high-speed low-torque mode for driving a screw (not shown), a button 2*a* of the switch unit 2 is pressed, thereby moving a link element 2*b* of the switch unit 2 downward to urge the drive component 3*a* of the clutch unit 3 away from the locking component 8*b* against the action of a spring 3*b*. At this time, rotation of the drive ring 7 will enable the driven gear sets 6 to rotate the drive shaft 8 at a speed faster than the rotating speed of the drive ring 7. Thus, the drive shaft 8 can drive rotatably the tool bit 9 at a relatively high speed but with a relatively low torque.

When it is desired to operate the fastener-driving tool in a low-speed high-torque mode, the button 2*a* of the switch unit 2 is released to enable the drive component 3*a* to once again engage the locking component 8*b* on the drive shaft 8 by virtue of the biasing action of the spring 3*b*. At this time, axial rotation of the handle body 1 can result in simultaneous rotation of the drive shaft 8 for driving rotatably the tool bit 9 at a relatively low speed but with a relatively high torque.

It is noted that the aforementioned conventional dual-mode fastener-driving tool is awkward to use since, aside from the forces exerted on the switch unit 2 and the drive ring 7, the user further applies a downward force on the handle body 1 when operating the fastener-driving tool. In addition, since the conventional dual-mode fastener-driving tool does not incorporate spaces for receiving different types of tool bits 9, the tool bits 9 must be placed in a separate toolbox, thereby resulting in inconvenience.

SUMMARY OF THE INVENTION

Therefore, the main object of the present invention is to provide a dual-mode fastener-driving tool that obviates the need for operating a switch unit when switching between two operating modes to permit smooth operation of the tool.

Another object of the present invention is to provide a dual-mode fastener-driving tool that incorporates spaces for receiving different types of tool bits therein.

Accordingly, the dual-mode fastener-driving tool of this invention comprises a handle body, a clutch unit, a drive shaft, a drive ring, and a driven gear assembly.

The handle body is formed with an axial hole.

The clutch unit includes a coupler, a clutch rod, and a biasing member. The coupler has a lower force-bearing ring portion disposed below the handle body, and an upper shaft portion extending upwardly from the force-bearing ring portion and engaging slidably and non-rotatably the handle body in the axial hole. The coupler is formed with an axial slide hole through the upper shaft portion and the force-bearing ring portion. The clutch rod extends slidably and non-rotatably through the slide hole of the coupler and into the axial hole of the handle body. The clutch rod has a top end coupled to the handle body, and a bottom end formed with a clutch socket that is disposed on a bottom side of the force-bearing ring portion. The biasing member is provided between the handle body and the force-bearing ring portion to bias the handle body away from the force-bearing ring portion, thereby pulling the clutch rod upwardly so as to dispose the clutch socket in a normal retracted position relative to the force-bearing ring portion. The handle body is forcible to move downwardly toward the force-bearing ring portion against action of the biasing member to move the clutch rod and dispose the clutch socket in an extended position relative to the force-bearing ring portion.

The drive shaft has an upper portion which engages removably and non-rotatably the clutch socket when the clutch socket is in the extended position to permit rotation of the drive shaft with the handle body. The upper portion of the drive shaft disengages the clutch socket when the clutch socket is in the retracted position to permit idle rotation of the drive shaft relative to handle body. The upper portion of the drive shaft is provided with a drive gear. The drive shaft further has a lower portion provided with an adapter. The adapter is adapted to couple a fastener to the drive shaft.

The drive ring is mounted rotatably on the drive shaft, and has an annular wall around the upper portion of the drive shaft and formed with internal gear teeth.

The driven gear assembly is enclosed by the drive ring and meshes with the internal gear teeth of the drive ring and the drive gear on the drive shaft to permit rotation of the drive shaft relative to the handle body when the drive ring is rotated while the clutch socket is in the retracted position.

Preferably, the handle body has an upper portion formed with a plurality of axially extending blind bores around the axial hole. The blind bores are adapted to receive nut sockets of different sizes therein. The outer wall surface of the handle body is further formed with a plurality of axially extending tool-bit recesses that are adapted for receiving tool bits therein.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
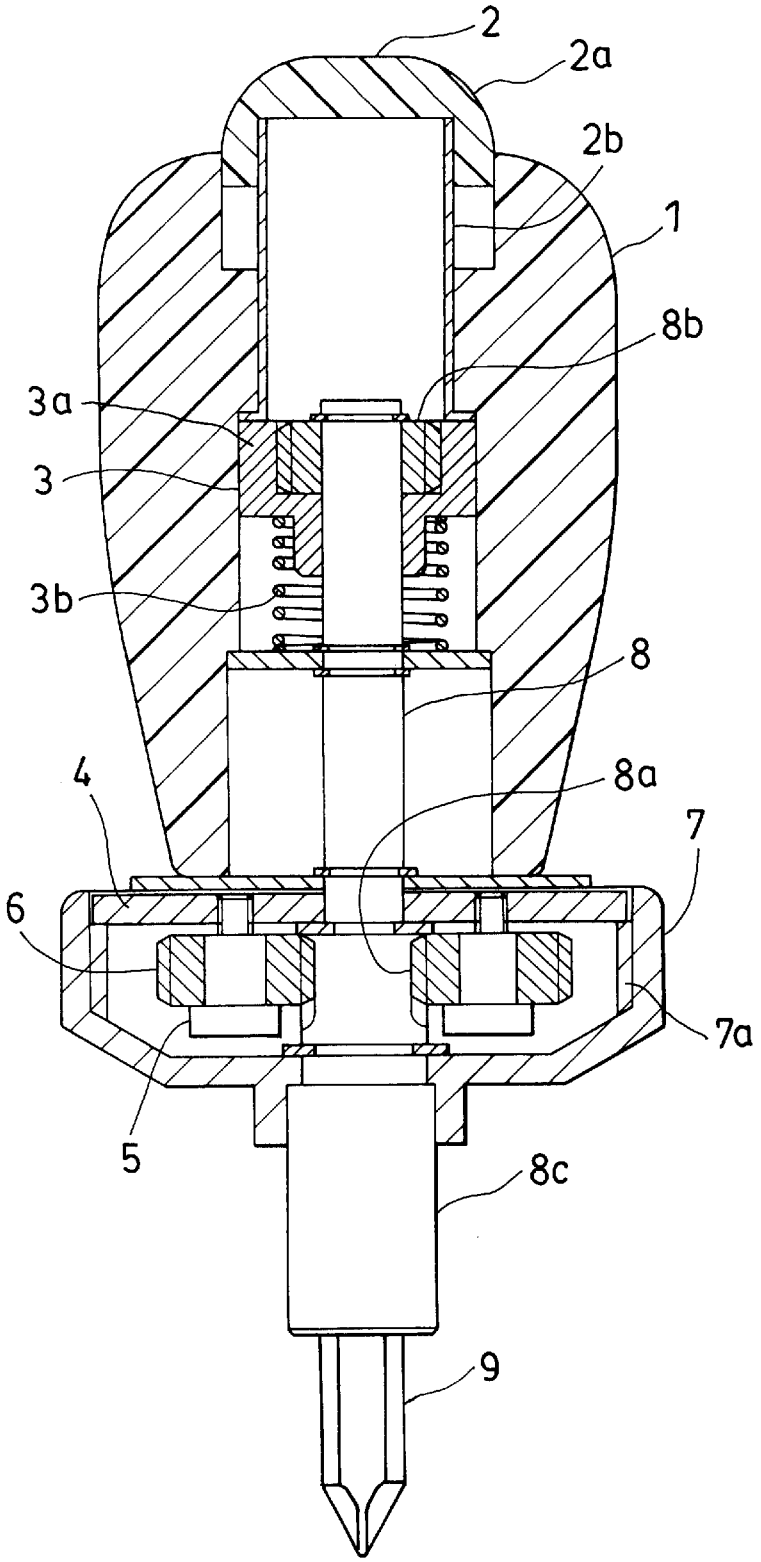
FIG.1 PRIOR ART
FIG. 1 is a schematic sectional view illustrating a conventional dual-mode fastener-driving tool.
Figure 2:
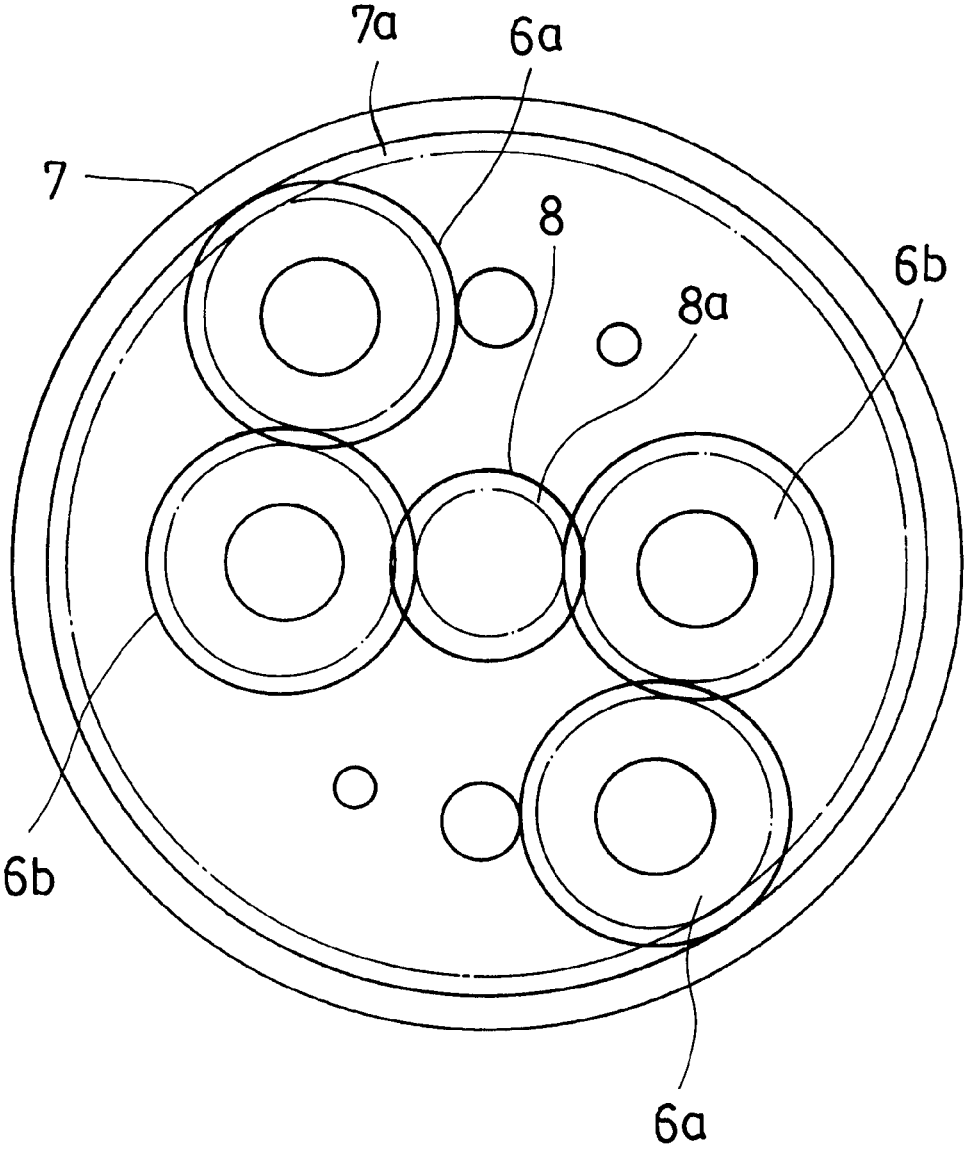
FIG.2 PRIOR ART
FIG. 2 is a schematic view illustrating a gear arrangement employed in the conventional dual-mode fastener-driving tool of FIG. 1.
Figure 3:
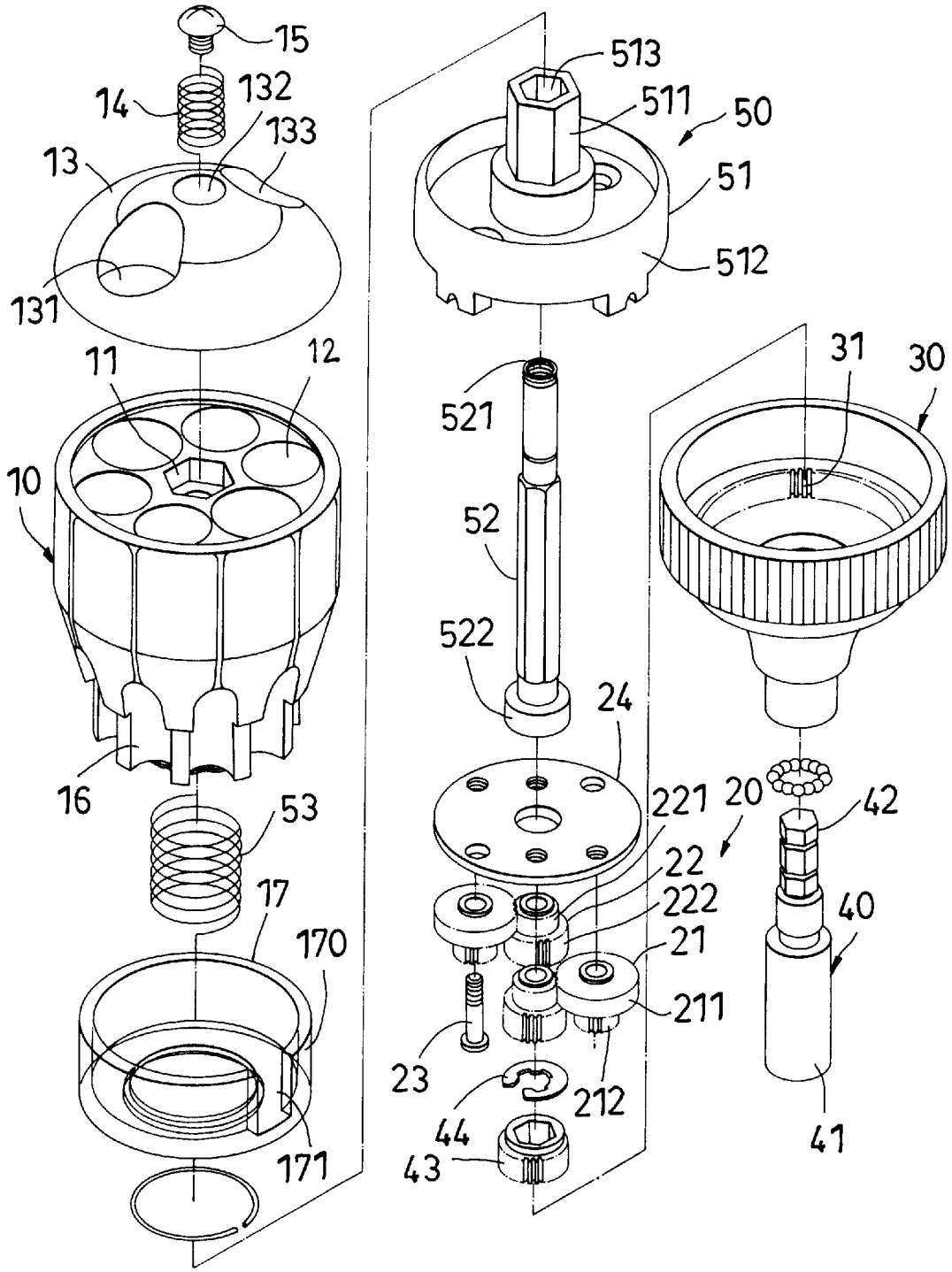
FIG. 3 is an exploded perspective view of the preferred embodiment of a dual-mode fastener-driving tool according to the present invention.
Figure 4:
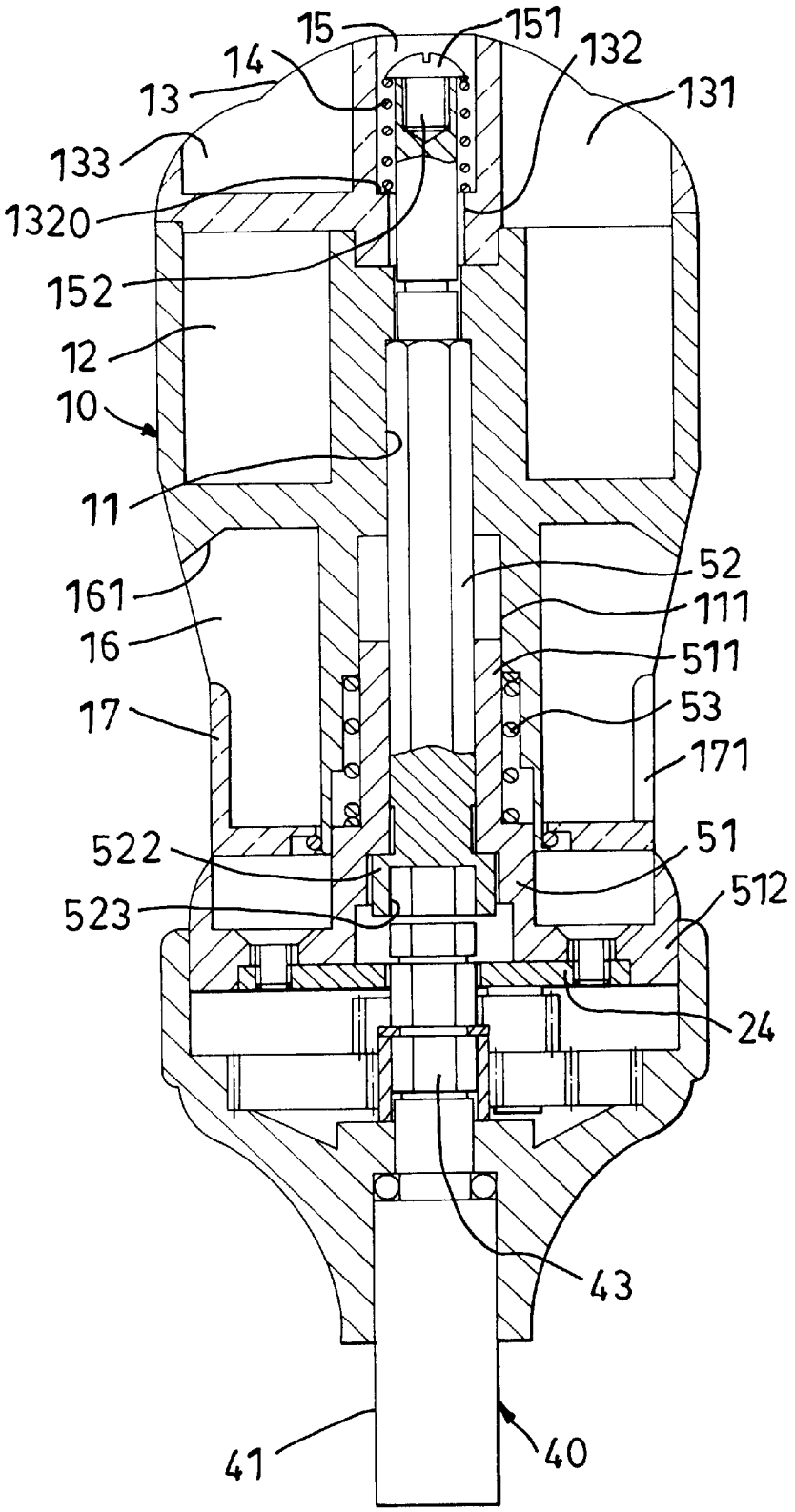
FIG. 4 is a schematic sectional view of the preferred embodiment.
Figure 5:
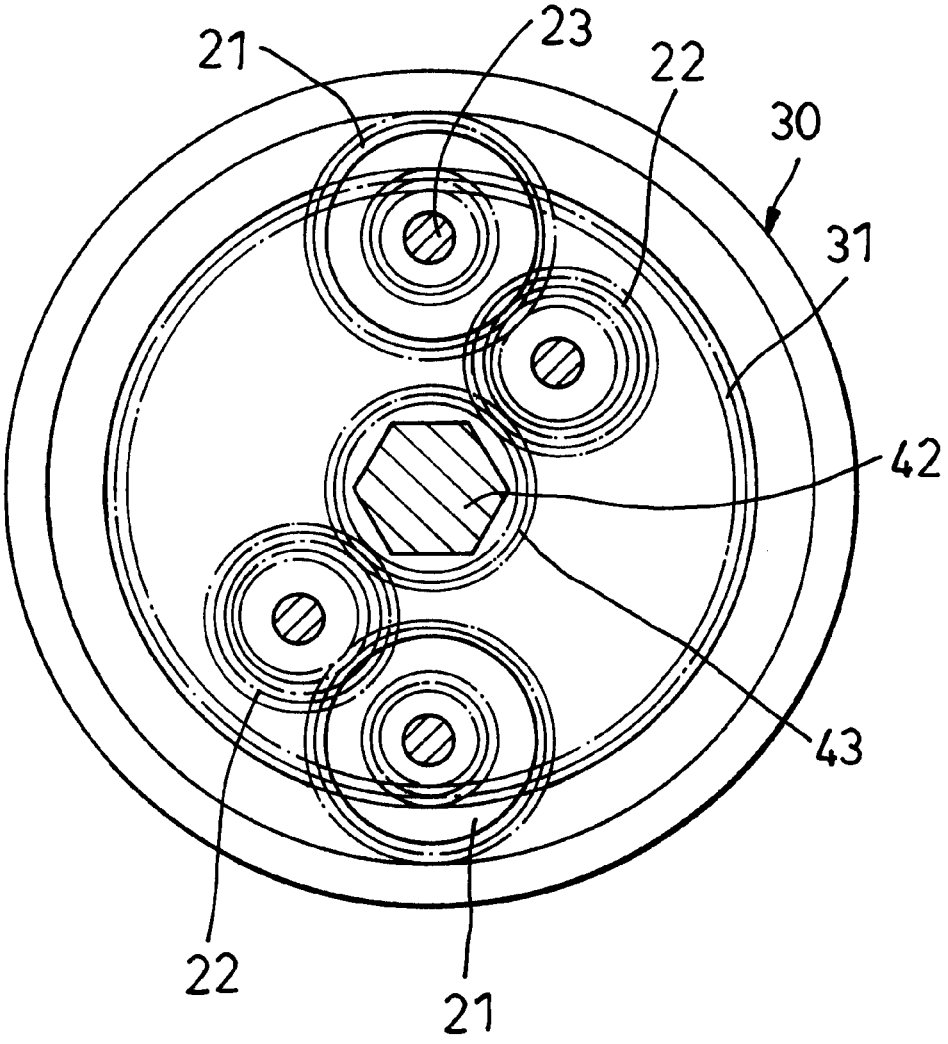
FIG. 5 is a schematic view illustrating a gear arrangement employed in the preferred embodiment.
Figure 6:
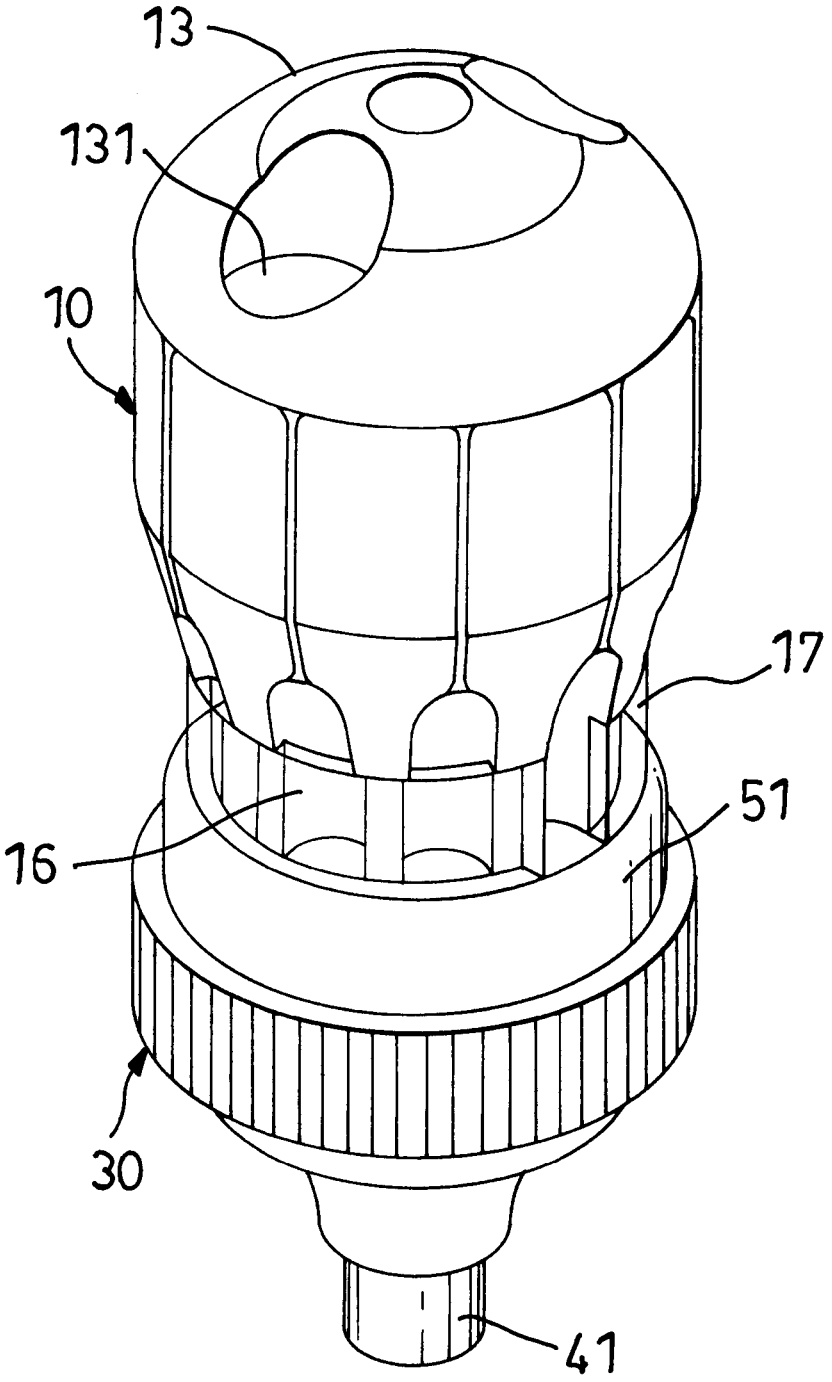
FIG. 6 is an assembled perspective view of the preferred embodiment.

Referring to FIGS. 3, 4, 5 and 6, the preferred embodiment of a dual-mode fastener-driving tool according to the present invention is shown to comprise a handle body 10 formed with an axial hole 11. The axial hole 11 has an intermediate portion 111 with a polygonal cross-section. Two driven gear sets 20 are disposed below the handle body 10. Each driven gear set 20 includes a primary driven gear unit 21 and a secondary driven gear unit 22. In this embodiment, each driven gear unit 21, 22 includes coaxial upper and lower gears 211, 212, 221, 222, and is disposed below a mounting plate 24. The driven gear units 21, 22 are mounted rotatably on the mounting plate 24 by means of bolts 23. The upper gear 211 of the primary driven gear unit 21 is larger than the lower gear 212. The upper gear 221 of the secondary driven gear unit 22 is smaller than the lower gear 222. The driven gear sets 20 and the mounting plate 24 constitute a driven gear assembly. A drive ring 30 encloses the driven gear sets 20 and has an annular wall that is formed with internal gear teeth 31 for meshing with the lower gear 212 of each primary driven gear unit 21. The upper gears 221 of the secondary driven gear units 22 mesh with the upper gears 211 of the primary driven gear units 21, respectively. The drive ring 30 is mounted rotatably on a drive shaft 40. The drive shaft 40 has an upper portion 42 that extends through the mounting plate 24 and the drive ring 30 and that is disposed between the secondary driven gear units 22. The upper portion 42 of the drive shaft 40 has a polygonal cross-section and is provided fittingly with a drive gear 43 for meshing with the lower gears 222 of the secondary driven gear units 22. Thus, the lower gears 222 of the secondary driven gear units 22 are capable of driving rotatably the drive shaft 40 when the drive ring 30 is rotated. A C-shaped retaining ring 44 retains the drive gear 43 on the drive shaft 40. The upper portion 42 of the drive shaft 40 engages a clutch unit 50 that extends into the axial hole 11 of the handle body 10. The lower portion of the drive shaft 40 is provided with an adapter 41 that is adapted to engage a nut socket 60 for coupling a nut (not shown) to the drive shaft 40, or a screw-driving tool bit 70 (see FIGS. 7 and 8). In the following description, the fastener 80 that is to be driven by the fastener-driving tool of the preferred embodiment is a screw.

Figure 7:
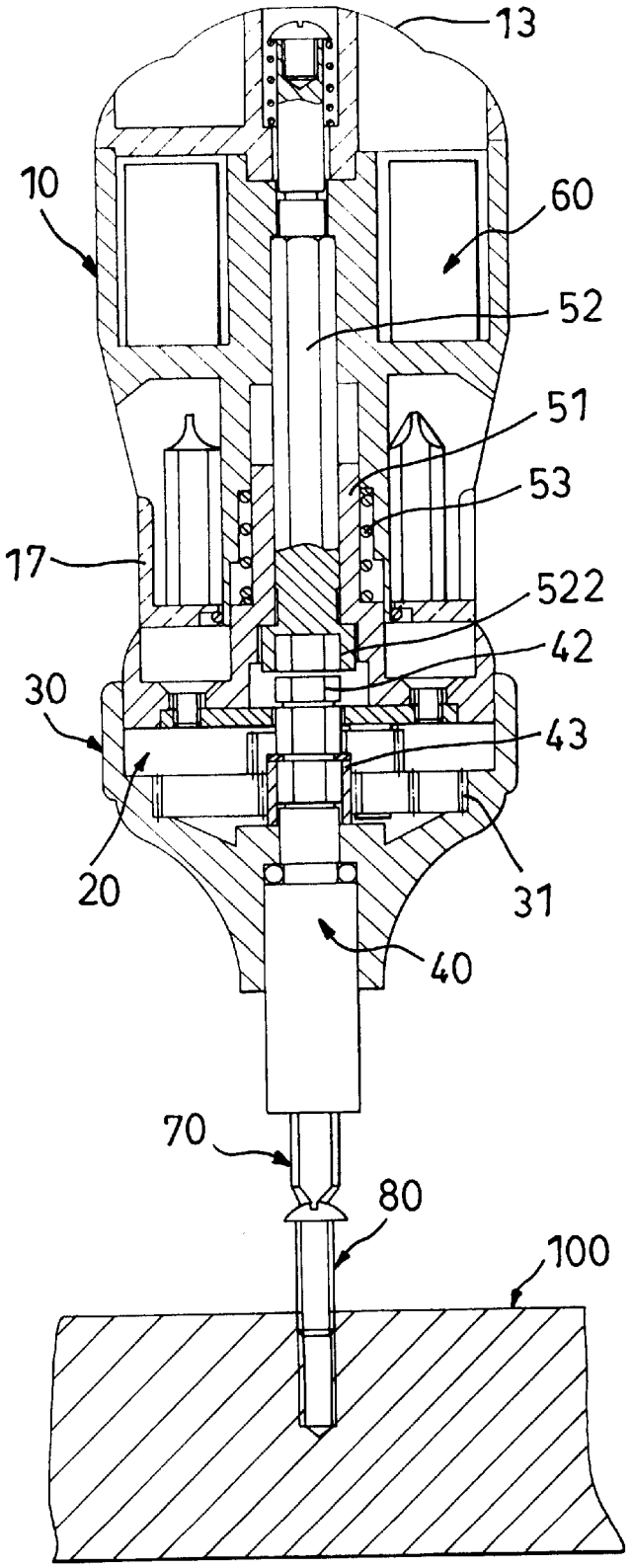
FIG. 7 is a schematic sectional view illustrating an operating mode of the preferred embodiment.
Figure 8:
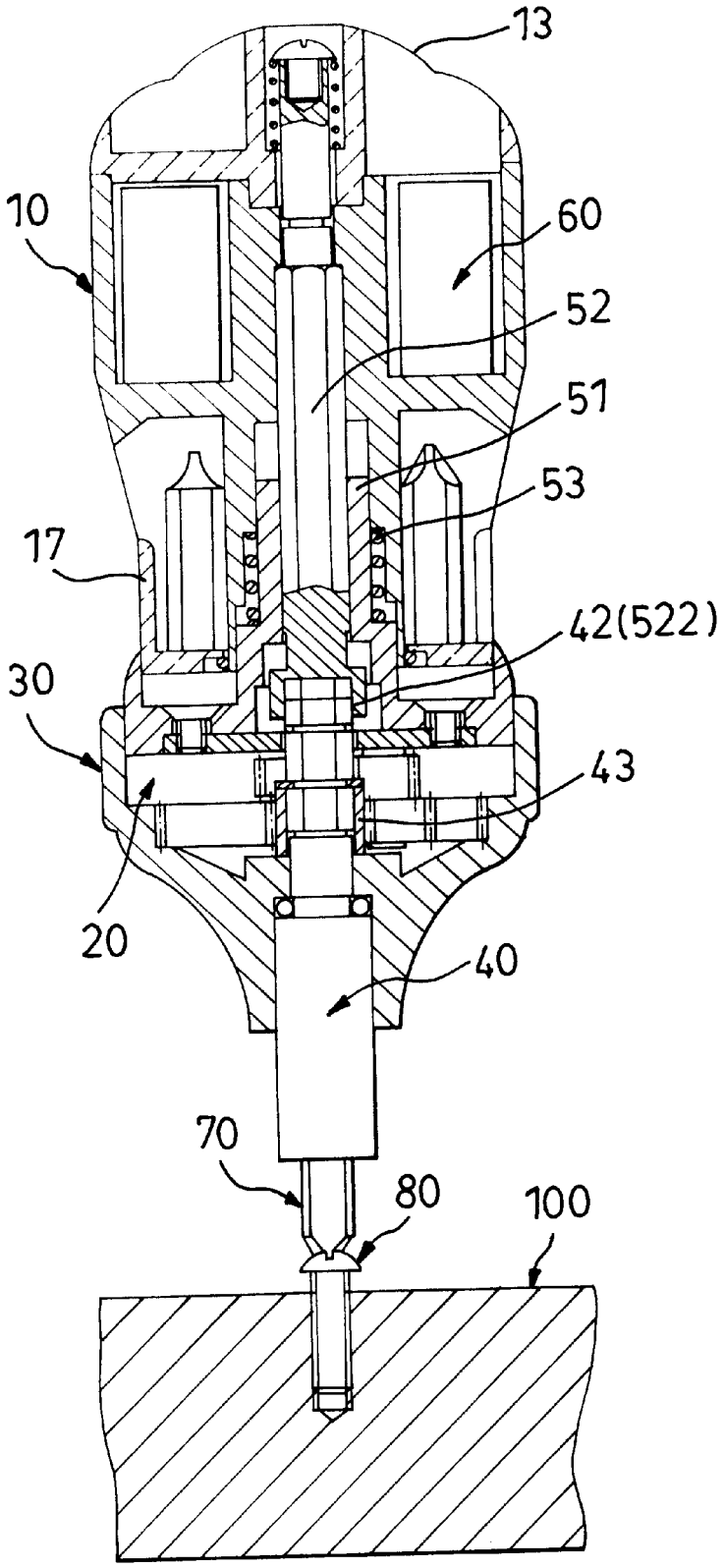
FIG. 8 is a schematic sectional view illustrating another operating mode of the preferred embodiment.

The handle body 10 has an upper portion formed with a plurality of axially extending blind bores 12 around the axial hole 11 and accessible via the top end of the handle body 10. The blind bores 12 are adapted to receive nut sockets 60 of different sizes therein, as shown in FIGS. 7 and 8. A transparent upper cover 13 is disposed above the handle body 10 and is adapted to retain the nut sockets 60 in the blind bores 12. The upper cover 13 is formed with a central mounting hole 132 with a wider upper section and a narrower lower section, and an opening 131 that is offset from the mounting hole 132. Each of the nut sockets 60 can be removed from the blind bores 12 when the opening 131 is registered with the appropriate one of the blind bores 12. A spring member 14 and a screw fastener 15 constitute a spring-loaded retainer that is disposed in the wider upper section of the mounting hole 132. The upper and lower ends of the spring member 14 abut against the head portion 151 of the screw fastener 15 and a shoulder 1320 in the mounting hole 132, respectively, thereby biasing the head portion 151 away from the upper cover 13. The upper cover 13 is further formed with a finger groove 133 on one side of the mounting hole 132 opposite to the opening 131. As such, the upper cover 13 can be handled at the opening 131 and the finger groove 133 for rotating the upper cover 13 relative to the handle body 10.

The handle body 10 is further formed with a plurality of axially extending tool-bit recesses 16 on an outer wall surface thereof. Each of the tool-bit recesses 16 is adapted to receive a tool bit 70 therein, as shown in FIGS. 7 and 8. In this embodiment, the tool-bit recesses 16 are angularly spaced apart and are disposed on a lower portion of the handle body 10. Each of the tool-bit recesses 16 is confined by a top wall with a radial outward extension that inclines downwardly to facilitate removal of the tool bits 70 from the tool-bit recesses 16. A transparent lower cover 17 is provided rotatably on the bottom end of the handle body 10 and is adapted to cover the tool-bit recesses 16 so as to retain the tool bits 70 in the latter. The lower cover 17 has an annular surrounding wall 170 that extends around the handle body 10 and that is formed with an upright slot 171. In use, the slot 171 can be registered with a selected one of the tool-bit recesses 16 for removal of the tool bit 70 that is received in the latter.

The clutch unit 50 includes a coupler 51, a clutch rod 52, and a biasing member 53. The coupler 51 has a lower force-bearing ring portion 512 that is disposed below the lower cover 17, and an upper shaft portion 511 that extends upwardly from the force-bearing ring portion 512. The shaft portion 511 has an outer wall surface with a polygonal cross-section that complements the cross-section of the intermediate portion 111 of the axial hole 11 in the handle body 10. Thus, the shaft portion 511 can engage slidably and non-rotatably the handle body 10 in the axial hole 11. The mounting plate 24 is mounted on the bottom side of the force-bearing ring portion 512. The coupler 51 is further formed with an axial slide hole 513 that is polygonal in cross-section and that extends through the shaft portion 511 and the force-bearing ring portion 512.

The clutch rod 52 has a polygonal cross-section that complements the cross-section of the slide hole 513. Thus, the clutch rod 52 can extend slidably and non-rotatably through the slide hole 513 and into the axial hole 11 from the bottom side of the force-bearing ring portion 512. The top end of the clutch rod 52 extends into the mounting hole 132 in the transparent upper cover 13, and is formed with a screw hole 521 for engaging a threaded shank portion 152 of the screw 15, thereby coupling rotatably the upper cover 13 to the top end of the clutch rod 52. The bottom end of the clutch rod 52 is formed with a clutch socket 522 that confines a bore 523 and that is disposed on the bottom side of the force-bearing ring portion 512. The bore 523 has a polygonal cross-section that complements the cross-section of the upper portion 42 of the drive shaft 40 so as to enable the clutch socket 522 to engage removably and non-rotatably the upper portion 42 of the drive shaft 40.

The biasing member 53 is a coil spring that is disposed around the upper shaft portion 511 of the coupler 51 and that is disposed between the handle body 10 and the force-bearing ring portion 512 to bias the handle body 10 away from the force-bearing ring portion 512, thereby pulling the clutch rod 52 upwardly so as to dispose the clutch socket 522 in a normal retracted position relative to the force-bearing ring portion 512. The upper portion 42 of the drive shaft 40 disengages the clutch socket 522 when the latter is in the retracted position to permit idle rotation of the drive shaft 40 relative to the handle body 10.

Referring to FIG. 7, when operating the fastener-driving tool of the preferred embodiment in a high-speed low-torque mode to drive a fastener 80 into or out of a work piece 100, the drive ring 30 is rotated, thereby enabling the driven gear sets 20 to drive rotatably the drive shaft 40. Since the number of gear teeth 31 on the drive ring 30 is larger than that on the drive gear 43, one complete rotating cycle of the drive ring 30 will result in several rotating cycles of the drive shaft 40, thereby enabling the tool bit 70 to drive the fastener 80 at a relatively high speed but with a relatively low torque.

Referring to FIG. 8, when operating the fastener-driving tool of the preferred embodiment in a low-speed high-torque mode to drive the fastener 80 into or out of the work piece 100, the handle body 10 is forced to move downward toward the force-bearing ring portion 512 against the action of the biasing member 53 to move the clutch rod 52 and dispose the clutch socket 522 in an extended position relative to the force-bearing ring portion 512. At this time, the clutch socket 522 engages the upper portion 42 of the drive shaft 40 so that, when the handle body 10 is rotated, the drive shaft 40 can rotate therewith in order to drive the fastener 80 at a relatively low speed but with a relatively high torque.

It has thus been shown that, in the dual-mode fastener-driving tool of this invention, switching from the high-speed low-torque mode to the low-speed high-torque mode can be easily accomplished by mere application of a downward force on the handle body 10 without the need for operating a switch unit as taught in the prior art. The fastener-driving tool of this invention is therefore easier to operate. In addition, the presence of the blind bores 12 and the tool-bit recesses 16 enable the handle body 10 to receive different nut sockets 60 and screw-driving tool bits 70, thereby obviating the need for carrying the sockets 60 and the tool bits 70 in a separate toolbox. Moreover, since each driven gear unit 21, 22 includes coaxial upper and lower gears 211, 212, 221, 222, the drive shaft 40 can be driven to rotate at a faster speed in the high-speed low-torque mode as compared to the aforementioned prior art.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A dual-mode fastener-driving tool, comprising:

a handle body formed with an axial hole;

a clutch unit including a coupler having a lower force-bearing ring portion disposed below said handle body, and an upper shaft portion extending upwardly from said force-bearing ring portion and engaging slidably and non-rotatably said handle body in said axial hole, said coupler being formed with an axial slide hole through said upper shaft portion and said force-bearing ring portion, a clutch rod extending slidably and non-rotatably through said slide hole of said coupler and into said axial hole of said handle body, said clutch rod having a top end coupled to said handle body and a bottom end formed with a clutch socket that is disposed on a bottom side of said force-bearing ring portion, and a biasing member provided between said handle body and said force-bearing ring portion to bias said handle body away from said force-bearing ring portion, thereby pulling said clutch rod upwardly so as to dispose said clutch socket in a normal retracted position relative to said force-bearing ring portion, said handle body being forcible to move downwardly toward said force-bearing ring portion against action of said biasing member to move said clutch rod and dispose said clutch socket in an extended position relative to said force-bearing ring portion;

a drive shaft having an upper portion which engages removably and non-rotatably said clutch socket when said clutch socket is in the extended position to permit rotation of said drive shaft with said handle body, said upper portion of said drive shaft disengaging said clutch socket when said clutch socket is in the retracted position to permit idle rotation of said drive shaft relative to handle body, said upper portion of said drive shaft being provided with a drive gear, said drive shaft further having a lower portion provided with an adapter, said adapter being adapted to couple a fastener to said drive shaft;

a drive ring mounted rotatably on said drive shaft and having an annular wall around said upper portion of said drive shaft and formed with internal gear teeth; and a driven gear assembly enclosed by said drive ring and meshing with said internal gear teeth of said drive ring and said drive gear on said drive shaft to permit rotation of said drive shaft relative to said handle body when said drive ring is rotated while said clutch socket is in the retracted position.

2. The dual-mode fastener-driving tool as claimed in claim 1, wherein said handle body has an upper portion formed with a plurality of axially extending blind bores around said axial hole, said blind bores being adapted to receive nut sockets of different sizes therein, said adapter being adapted to engage the nut sockets for coupling a nut to said drive shaft.

3. The dual-mode fastener-driving tool as claimed in claim 2, further comprising an upper cover disposed above said handle body and coupled rotatably to said top end of said clutch rod, said upper cover covering said blind bores so as to be adapted to retain the nut sockets in said blind bores.

4. The dual-mode fastener-driving tool as claimed in claim 3, wherein said upper cover is formed with a central mounting hole to permit extension of said top end of said clutch rod therein, said fastener-driving tool further comprising a spring-loaded retainer disposed in said central mounting hole for coupling rotatably said upper cover to said top end of said clutch rod.

5. The dual-mode fastener-driving tool as claimed in claim 4, wherein said spring-loaded retainer includes a screw fastener having a head portion and a threaded shank portion that engages said top end of said clutch rod, and a spring member for biasing said head portion of said screw fastener away from said upper cover.

6. The dual-mode fastener-driving tool as claimed in claim 4, wherein said upper cover is formed with an opening that is offset from said central mounting hole and that is adapted to permit removal of the nut socket in a selected one of said blind bores when said upper cover is rotated relative to said handle body for registering said opening with the selected one of said blind bores.

7. The dual-mode fastener-driving tool as claimed in claim 6, wherein said upper cover is further formed with a finger groove on one side of said central mounting hole opposite to said opening to permit handling of said upper cover at said opening and said finger groove for rotating said upper cover relative to said handle body.

8. The dual-mode fastener-driving tool as claimed in claim 3, wherein said upper cover is transparent.

9. The dual-mode fastener-driving tool as claimed in claim 1, wherein said handle body has an outer wall surface formed with a plurality of axially extending tool-bit recesses, said tool-bit recesses being adapted to receive tool bits therein, said adapter being adapted to engage removably and non-rotatably the tool bits.

10. The dual-mode fastener-driving tool as claimed in claim 9, wherein said tool-bit recesses are angularly spaced apart and are formed on a lower portion of said handle body, said fastener-driving tool further comprising a lower cover provided rotatably between said handle body and said force-bearing ring portion of said coupler for covering said tool-bit recesses so as to be adapted to retain the tool bits in said tool-bit recesses.

11. The dual-mode fastener-driving tool as claimed in claim 10, wherein said lower cover has an annular surrounding wall that extends around said handle body and that is formed with an upright slot, said upright slot being adapted to permit removal of the tool bit in a selected one of said tool-bit recesses when said lower cover is rotated relative to said handle body for registering said upright slot with the selected one of said tool-bit recesses.

12. The dual-mode fastener-driving tool as claimed in claim 10, wherein said lower cover is transparent.

13. The dual-mode fastener-driving tool as claimed in claim 9, wherein each of said tool-bit recesses is confined by a top wall with a radial outward extension that inclines downwardly to facilitate removal of the tool bit that is received therein.

14. The dual-mode fastener-driving tool as claimed in claim 1, wherein said axial hole and said upper shaft portion of said coupler have complementary polygonal cross-sections to enable said upper shaft portion to engage slidably and non-rotatably said handle body in said axial hole.

15. The dual-mode fastener-driving tool as claimed in claim 1, wherein said slide hole and said clutch rod have complementary polygonal cross-sections to enable said clutch rod to engage slidably and non-rotatably said coupler in said slide hole.

16. The dual-mode fastener-driving tool as claimed in claim 1, wherein said clutch socket confines a bore, said bore and said upper portion of said drive shaft having complementary polygonal cross-sections to enable said clutch socket to engage removably and non-rotatably said upper portion of said drive shaft.

17. The dual-mode fastener-driving tool as claimed in claim 1, wherein said driven gear assembly includes a pair of driven gear sets mounted rotatably on a bottom side of said force-bearing ring portion of said coupler, each of said driven gear sets including a primary driven gear unit and a secondary driven gear unit, said primary driven gear unit including coaxial first upper and first lower gears, said first lower gear being smaller than said first upper gear and meshing with said internal gear teeth of said drive ring, said secondary driven gear unit including coaxial second upper and second lower gears, said second upper gear being smaller than said second lower gear and meshing with said first upper gear of said primary driven gear unit, said second lower gear meshing with said driven gear on said drive shaft.

* * * * *